United States Patent [19]

Benavidez

[11] Patent Number: 4,987,812

[45] Date of Patent: Jan. 29, 1991

[54] COMBINATION RULER AND CUTTER GUIDE

[76] Inventor: Cande Benavidez, P.O. Box 282, Woodburn, Oreg. 97071

[21] Appl. No.: 431,446

[22] Filed: Nov. 3, 1989

[51] Int. Cl.[5] ..... B26D 7/02

[52] U.S. Cl. ..... 83/455; 83/614; 83/522.11

[58] Field of Search ..... 33/32.2, 32.1, 32.3; 83/455, 614, 745, 522.11, 522.18.522.19, 456, 459; 30/125, 289, 290, 291, 294

[56] References Cited

U.S. PATENT DOCUMENTS

| | | | |
|---|---|---|---|
| 197,901 | 12/1877 | Sargent | 83/455 |
| 1,908,851 | 5/1933 | Lafever et al. | 30/125 X |
| 2,964,848 | 12/1960 | Gonsalves | 33/32.1 |
| 3,363,314 | 1/1968 | O'Brien | 30/125 |
| 3,439,426 | 4/1969 | Wilson | 33/32.2 |
| 3,996,827 | 12/1976 | Logan | 83/455 |
| 4,056,027 | 11/1977 | Northrop | 83/455 |

*Primary Examiner*—Frank T. Yost
*Assistant Examiner*—Eugenia A. Jones
*Attorney, Agent, or Firm*—Eugene M. Eckelman

[57] ABSTRACT

A flat elongated body member has indicia markings on its top surface and a slot is provided in such top surface in which a cutter member is slidably guided. The cutter member has a rearward portion biased to an upwardly angled position by a spring. Such rearward portion supports a cutter blade on one side of the cutter member so as to lie closely adjacent one side edge of the body member. In the upper angled position of the rearward portion of the cutter member the cutting edge of the blade is disposed above the bottom surface of the body member but projects below such bottom surface in a cutting position when the rearward portion of the cutter member is forced downwardly. The cutter member includes a compartment for the storage of store cutter blades. Also the body member has one or more lateral projections for alignment in cutting functions.

5 Claims, 1 Drawing Sheet

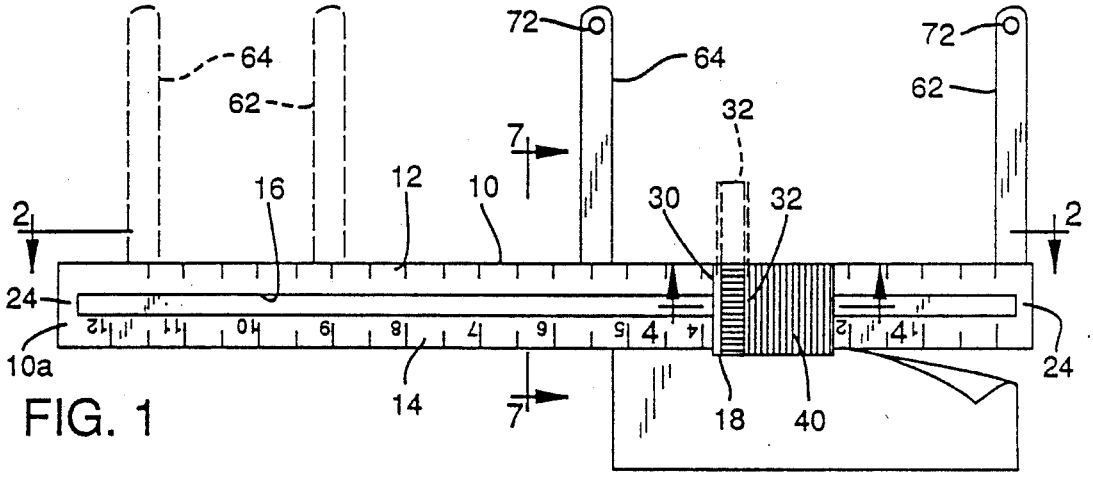
FIG. 1
FIG. 2
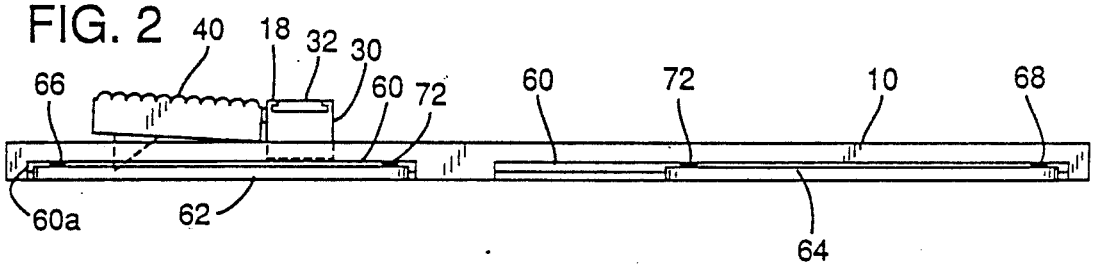
FIG. 3
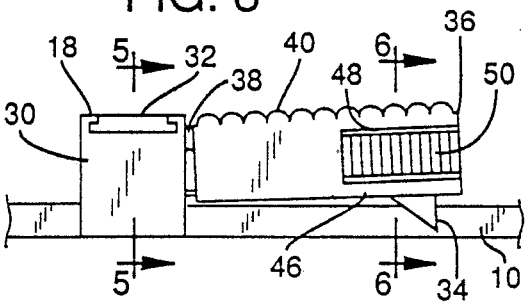
FIG. 4
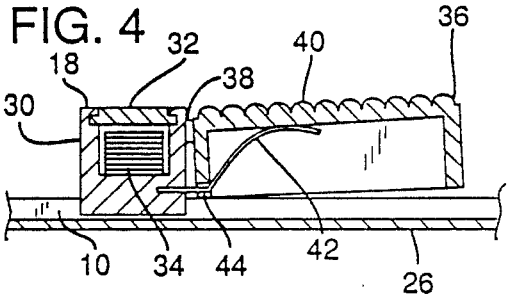
FIG. 5
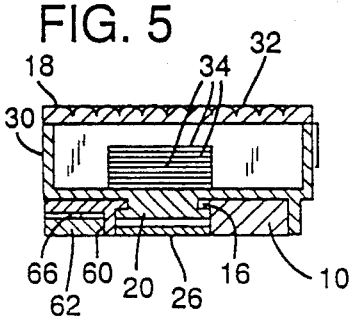
FIG. 6
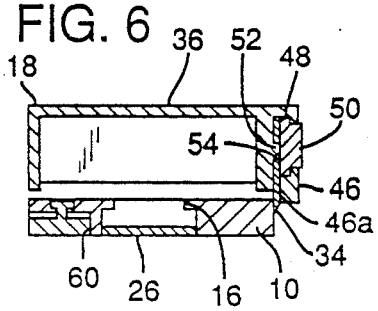
FIG. 7
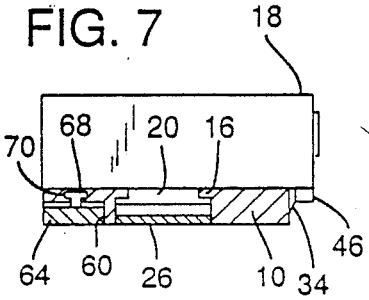

COMBINATION RULER AND CUTTER GUIDE

BACKGROUND OF THE INVENTION

Combination rulers and cutter guides have heretofore been employed wherein an elongated body member has measuring indicia thereon and also includes a cutting member or edge for severing material. For example, U.S. Pat. No. 101,542 shows such a combination ruler and cutter guide wherein a cutter member is mounted on a hinged arm and carries a cutter that operates through a slot in the body member on which the hinged arm is mounted. The material is inserted between the body member and the hinged arm for cutting. U.S. Pat. No. 180,362 also shows a device of the type described wherein measuring indicia is provided on one side flange and an opposite side flange includes a sharpened edge to form a paper cutter.

SUMMARY OF THE INVENTION

According to the present invention and forming a primary objective thereof, a combination ruler and cutter guide is provided having improved features which comprise ease of use, accuracy in use, versatility in use, and safety of operation.

In carrying out these objectives, the invention comprises a flat, elongated body member with indicia markings on the top surface thereof. A cutter member is slidably guided along the top surface of the body member and has a rearward portion which is biased upwardly to a rest inoperative position. An upright cutter blade is mounted on one side portion of the cutter member in depending relation closely adjacent one side edge of the body member and the parts are dimensioned and arranged such that the cutting edge of the cutter blade is disposed above the bottom surface of the body member in the upper rest position of the rearward portion of the cutter member but projects below the bottom surface of the body member in a cutting position when the upwardly biased rearward portion of the cutter member is forced downwardly, whereby to readily align and cut material, such as paper, by placing the body member on the material to be cut and drawing the cutter member in guided relation thereon. The body member includes pivoted and slidable lateral projections which can be swung outwardly to a use position to align the body member in cutting functions or which can be swung inwardly into a stored position. These lateral projections have measurement indicia thereon. The cutter member includes a storage compartment for cutter blades.

The invention will be better understood and additional objects and advantages will become apparent from the following description taken in connection with the accompanying drawings.

BRIEF DESCRIPTION OF THE DRAWINGS

FIG. 1 is a top plan view of the present combination ruler and cutter guide, this view showing the cutter member in a process of cutting a piece of paper and, also showing the lateral projections in extended position.

FIG. 2 is a side elevational view taken on the line 2—2 of FIG. 1 showing the lateral projections in folded position.

FIG. 3 is an enlarged fragmentary elevational view of the device showing the cutter member in particular.

FIG. 4 is an enlarged fragmentary sectional view of the cutter member taken on the line 4—4 of FIG. 1.

FIGS. 5 and 6 are cross sectional views taken on the lines 5—5 and 6—6 of FIG. 3, respectively, and FIG. 7 is a cross sectional view taken on the line 7—7 of FIG. 1.

DETAILED DESCRIPTION OF A PREFERRED EMBODIMENT

The present invention comprises a ruler or body member 10 having conventional measurement indicia 12 and 14 along its edges. The ruler has a longitudinal slot 16, FIGS. 1 and 5—7, which slidably guides a cutter member 18 in precise movement. A connected slidable engagement is provided between the ruler 10 and the cutter member 18 by means of a depending tongue 20 on the cutter member having a slidable tongue and groove type connection in slot 16. The ends 24 of the ruler at the slot are closed but for initial installation, one of these closed ends comprises an insert in manufacture which is secured in place for assembly. The bottom opening of the slot 16 is closed by a plate 26 adhesively or otherwise secured in place.

Cutter member 18 includes a forward portion 30 which has the depending tongue 20 thereon, FIG. 5, and which provides the guided movement along the ruler in the slot 16. Portion 30 of the cutter member is hollow, FIG. 5, and has a removable lid 32 which as shown in FIG. 1 can be moved laterally, The interior of portion 30 is capable of storing cutter blades 34.

The rearward portion 36 of the cutter member comprises an inverted box-like member, best seen in FIGS. 3 and 4, with a hinge connection 38 to the forward portion 30. This rearward portion has a top cross ribbed surface 40 that provides a good finger grip thereon. This rearward portion is held in an upwardly angled rest position by a leaf spring 42, FIG. 4, anchored at one of its ends to an inside end surface of the forward portion 30. The cutter member is molded of a semi-resilient material and the hinge connection 38 comprises and integral web of the material between the forward and rearward portions. The spring projects through suitable apertures 44 in the rearward portion 36 and is embedded in the forward portion 36. One side of the rearward portion 36 has a depending flange 46, FIG. 6, the inner vertical surface **46*a* of which is parallel with the adjacent side of the ruler and spaced a very small distance outwardly therefrom. Flange 46 has a rear opening side slot 48 also seen in FIG. 3, which provides a tongue and groove slidable connection for a slide panel 50 and which holds a cutter blade 34 in the rear of the slot. The inner side of slot 48 has a laterally extending projection 52, and the blades 34 have an aperture 54 that mounts the blade on the projection. The parts are dimensioned and arranged such that the slide panel 50 when in a forward or closed position firmly holds the blade in place in the slot. The bottom cutting edge of the blade projects a short distance below the bottom of the rearward hinged portion 36, as seen in FIG. 3**.

As also seen in FIG. 3, in the rest position of the rearward portion 36, it angles upwardly and the bottom cutting edge of blade 34 is spaced above the bottom surface of the ruler. When it is desired to cut material, such as paper, on which the ruler rests, it is merely necessary to press down on the rearward portion 36 and at the same time slide the cutter member along the ruler. The blade works closely adjacent the one edge of the ruler and is mostly concealed by the depending flange portion 46. Thus, the blade cannot accidentally come into contact with persons handling the ruler.

With reference to FIGS. 1, 2, and 5–7, the side of the ruler opposite from the cutting blade side has cutouts or recesses 60 in the bottom surface in which lateral rulers or arms 62 and 64, FIGS. 1, 2 and 5–7, are mounted. Ruler 62 has a suspended pivot support 66, FIG. 2, at one of its ends and is arranged to be swung from a stored position in the ruler, FIG. 2, to a laterally extending position, FIG. 1. This ruler, when swung outwardly to the FIG. 1 position, abuts against end 60*a* of cutout 60 for right angle extension to the ruler 10. Ruler 64 has a slidable pivot support 68 in a groove 70, FIG. 7, and can be swung out to angular positions relative to ruler 10 and also adjusted longitudinally of ruler 10 in its swung out position. The rulers 62 and 64 have conventional measurement indicia thereon. These rulers also have a detent 72 on their upper surface at the end opposite from the pivot end which engages the top of the slot 60 and frictionally holds the ruler in the slot in their non-use position.

In the use of the present ruler and cutter guide it is merely laid on the material to be cut and the cutter member drawn across the line to be cut after first depressing the rearward portion 36. The end of the ruler on which the cutter member travels has an extension 10*a* of the slot 16 and beyond the indicia so that the cutter member can travel the full length of the indicia containing portion of the ruler. If alignment is desired, as for example precisely at right angle to an edge of the paper, one or both laterally extending rulers 62 and 64 can be brought into play. The lateral ruler 64 can be slid to desired positions along the one end of the ruler if alignment is desired in this location. When the operator releases pressure on the rearward portion 36, such portion will move up to its rest position under the biasing action of spring 42 and the blade 34 will be lifted to a position above the bottom surface of the ruler.

The device is thus easy to use and cuts are made accurately along the straight edge of the ruler. The cuts may be made to selected lengths by determining the travel of the cutter member on the ruler. The device has safety of operation in that the blade is well protected and does not cut unless the member 36 is forced down physically.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A combination ruler and cutter guide comprising:

a flat, elongated body member having top and bottom surfaces and end and outer defining side edges;

indicia markings on the top surface of said body member adjacent at least one of said outer defining edges;

longitudinal slot means in said body member;

a cutter member slidably guided in said slot means;

said cutter member including forward, rearward and side portions;

one of said side portions of said cutter member having a depending flange with a vertical surface parallel with said one of said outer defining side edges of said body member, said rearward portion having upper and lower positions with said upper position comprising a biased rest position, and an upright cutter blade having a bottom cutting edge, said cutter blade being mounted on said vertical surface of said flange in depending relation closely adjacent the said one of said outer defining side edges of said body member, said rearward portion of said cutter member and said cutter blade being dimensioned and arranged such that the cutting edge of said cutter blade is disposed above the bottom surface of the body member in the upper rest position of said rearward portion and projects below the bottom surface face of said body member in a cutting position in the lower position of said rearward portion.

2. The combination ruler and cutter guide of claim 1 wherein the rearward portion of said cutter member has a hinged connection to the forward portion of said cutter member and said rearward portion is biased upwardly by spring means acting between said forward and rearward portions, said cutter member being molded of a semi-resilient material and said hinged connection comprising an integral web of said material between said forward and rearward portions.

3. The combination ruler and cutter guide of claim 1 wherein said depending flange on which the cutter blade is mounted includes a slot arranged to removably receive said cutter blade, and a slide panel closing said slot and holding said blade in position.

4. The combination ruler and cutter guide of claim 1 wherein the bottom surface of said body member has longitudinal recess means therein, at least one arm in said recess means, pivot means pivotally supporting said arm on said body member for movement between an aligning position extending laterally from said body member and a stored position in said recess means parallel with said body member.

5. The combination ruler and cutter guide of claim 4 wherein at least one of said arms and its pivot means are slidably adjustable on said body member for selectively locating said arm longitudinally of said body member.

* * * * *